US007350454B2

(12) United States Patent
Kapp

(10) Patent No.: US 7,350,454 B2
(45) Date of Patent: Apr. 1, 2008

(54) CYLINDER UNIT FOR MOUNTING ON A CROSS MEMBER AND/OR A TABLE OF A DEVICE OR MACHINE FOR THE DEFORMATION OF WORKPIECES

(75) Inventor: Dieter Kapp, Wilnsdorf (DE)

(73) Assignee: Theodor Gräbener GmbH & Co. KG, Netphen-Werthenbach (DE)

( * ) Notice: Subject to any disclaimer, the term of this patent is extended or adjusted under 35 U.S.C. 154(b) by 763 days.

(21) Appl. No.: 10/902,404

(22) Filed: Jul. 28, 2004

(65) Prior Publication Data

US 2005/0025635 A1 Feb. 3, 2005

(30) Foreign Application Priority Data

Jul. 30, 2003 (DE) ..... 103 34 671

(51) Int. Cl.
*F01B 1/00* (2006.01)
*B30B 1/34* (2006.01)

(52) U.S. Cl. ..... 92/146; 92/255; 100/269.08

(58) Field of Classification Search ..... 92/146, 92/255; 91/178, 533; 100/269.05, 269.08, 100/269.18
See application file for complete search history.

(56) References Cited

U.S. PATENT DOCUMENTS 2,399,824 A * 5/1946 Pressman ..... 269/33
2,954,068 A * 9/1960 Williamson ..... 100/269.06
5,020,422 A * 6/1991 Sims ..... 92/146
6,499,383 B2 * 12/2002 Shirakawa et al. ..... 91/178

FOREIGN PATENT DOCUMENTS

DE 4213490 C1 * 9/1993
DE 19615634 C1 * 9/1997

* cited by examiner

*Primary Examiner*—Michael Leslie
(74) *Attorney, Agent, or Firm*—Friedrich Kueffner

(57) ABSTRACT

A cylinder unit for mounting on a machine for the deformation of workpieces includes a cylinder block and a pressure plate which is arranged on the surface of the cylinder block which faces away from the fastening surface, wherein a plurality of pistons each having a spherically shaped head are mounted in the cylinder block. Mounted on each spherically shaped head of the pistons is a pressure piece which protrudes into a bore of the pressure plate and has a recess corresponding to the spherically shaped head of the pistons. A gap is provided between the outer diameter of the pressure piece and the inner diameter of the bore in the pressure plate. A pressure disc is arranged between the pressure piece and the pressure plate in the bottom of the bore of the pressure plate. Each pressure piece includes a coaxial guide pin which protrudes beyond the pressure piece in the direction of the piston, wherein the guide pin projects into a coaxial bore in the spherically shaped head of the piston, and wherein an elastic guide sleeve is provided in the coaxial bore between the guide pin and the coaxial bore.

4 Claims, 3 Drawing Sheets

Fig. 2
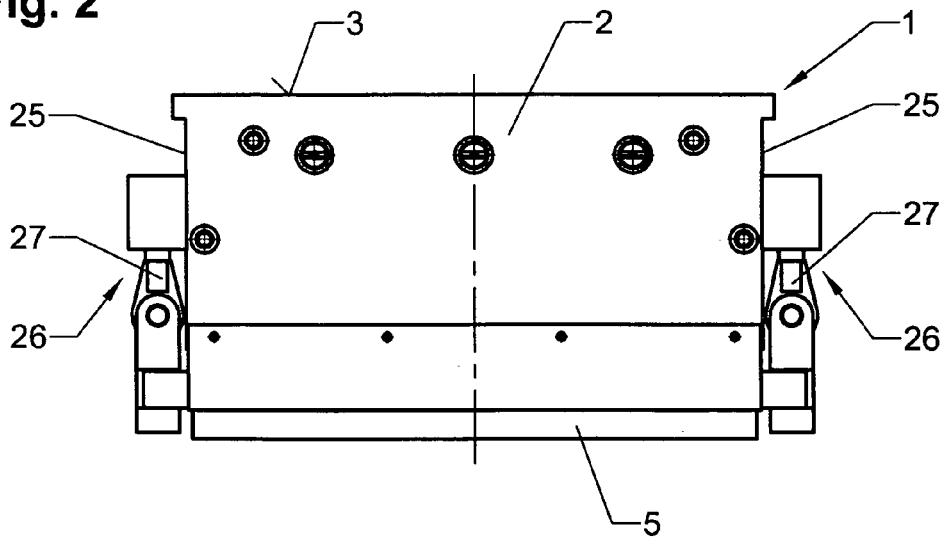
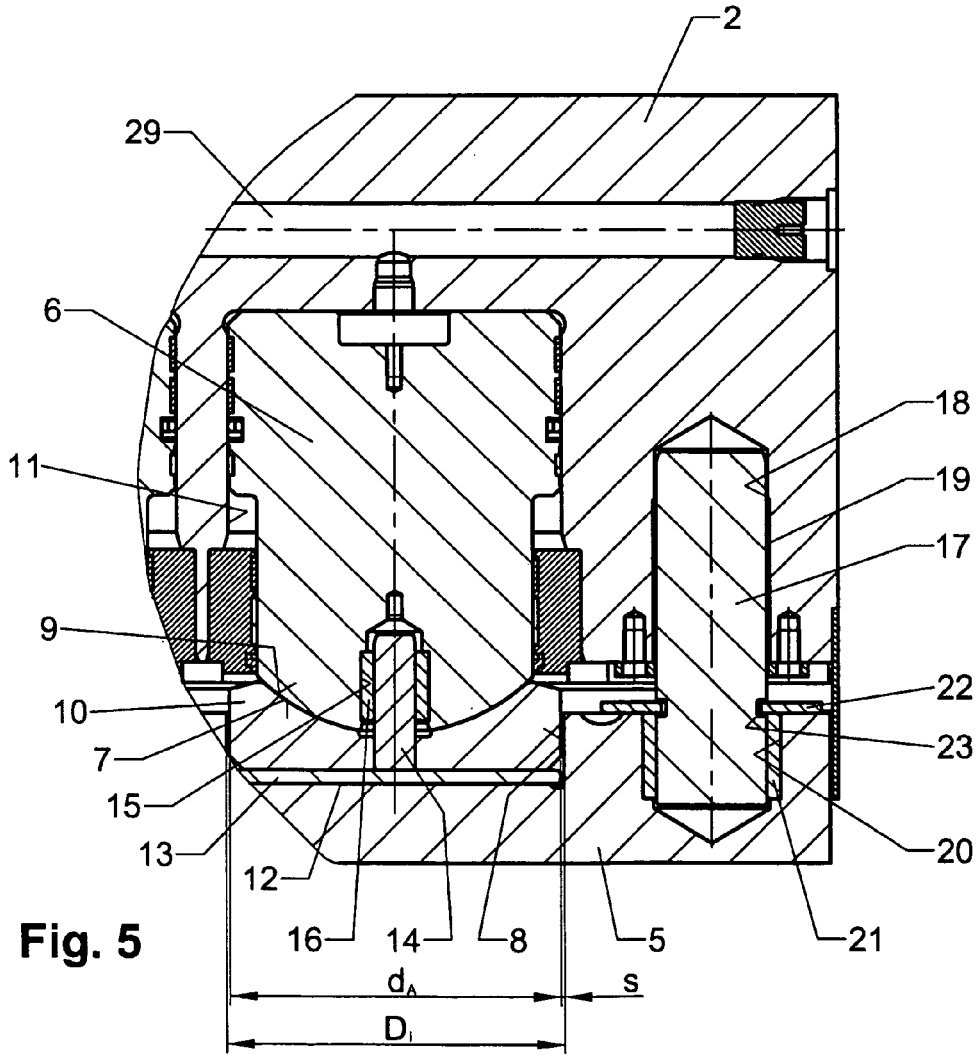
Fig. 5

CYLINDER UNIT FOR MOUNTING ON A CROSS MEMBER AND/OR A TABLE OF A DEVICE OR MACHINE FOR THE DEFORMATION OF WORKPIECES

BACKGROUND OF THE INVENTION

1. Field of the Invention

The present invention relates to a cylinder unit for mounting on a cross member and/or a table of a device or machine for the deformation of workpieces. The cylinder unit includes a cylinder block which can be mounted on the cross member and/or at the table and a pressure plate which is arranged on the surface of the cylinder block which faces away from the fastening surface, wherein a plurality of pistons each having a spherically shaped head are mounted in the cylinder block, wherein the pistons act on the pressure plate, and wherein guide bolts are arranged in the pressure plate which protrude into the cylinder block and are guided in the cylinder block.

2. Description of the Related Art

Cylinder units of the above-described type are known in the art. In these units, the spherically shaped heads of the pistons act directly on a pressure piece having a flat surface which is mounted in the pressure plate. This arrangement has the disadvantage that imprints of the pistons can be seen all the way into the workpiece.

Another disadvantage of the known cylinder units is to be seen in the fact that the guide systems of the units become easily misaligned because the cylinder block expands when it is heated by the hydraulic oil which actuates the pistons. As a result, at a temperature of 80° C., a length change of the cylinder block from one side to the other of almost 1 mm occurs.

SUMMARY OF THE INVENTION

Therefore, it is the primary object of the present invention to provide a cylinder unit in which the pistons do not produce any imprints on the workpiece, and in which the length changes of the cylinder block can be compensated very easily.

In accordance with the present invention, mounted on each spherically shaped head of the pistons is a pressure piece which protrudes into a bore of the pressure plate and has a recess corresponding to the spherically shaped head of the pistons. A gap is provided between the outer diameter of the pressure piece and the inner diameter of the bore in the pressure plate. A pressure disc is arranged between the pressure piece and the pressure plate in the bottom of the bore of the pressure plate. Each pressure piece includes a coaxial guide pin which protrudes beyond the pressure piece in the direction of the piston, wherein the guide pin projects into a coaxial bore in the spherically shaped head of the piston, and wherein an elastic guide sleeve is provided in the coaxial bore between the guide pin and the coaxial bore. In addition, an elastic guide sleeve is provided between the guide bolt and an additional bore in the pressure plate for the guide bolt, wherein the additional guide sleeve is mounted in the additional bore.

The cylinder unit according to the present invention has the particular advantage that each pressure piece, which is supported by the spherically shaped head of a piston and has a recess corresponding to the spherically shaped head, does not cause imprints or bulges on the deformed workpiece. In addition, the load is uniformly distributed over the workpiece.

The gap between the outer diameter of the pressure piece and the inner diameter of the bore for the pressure piece in the pressure plate as well as the elastic guide sleeves ensure that the guide systems are not misaligned as a result of length changes due to thermal expansion.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIG. 2. is a side view of the cylinder unit as seen in the direction of arrow II in FIG. 1;

FIG. 5 shows an enlarged detail of V of FIG. 4.

DETAILED DESCRIPTION OF THE INVENTION

Figure 1:
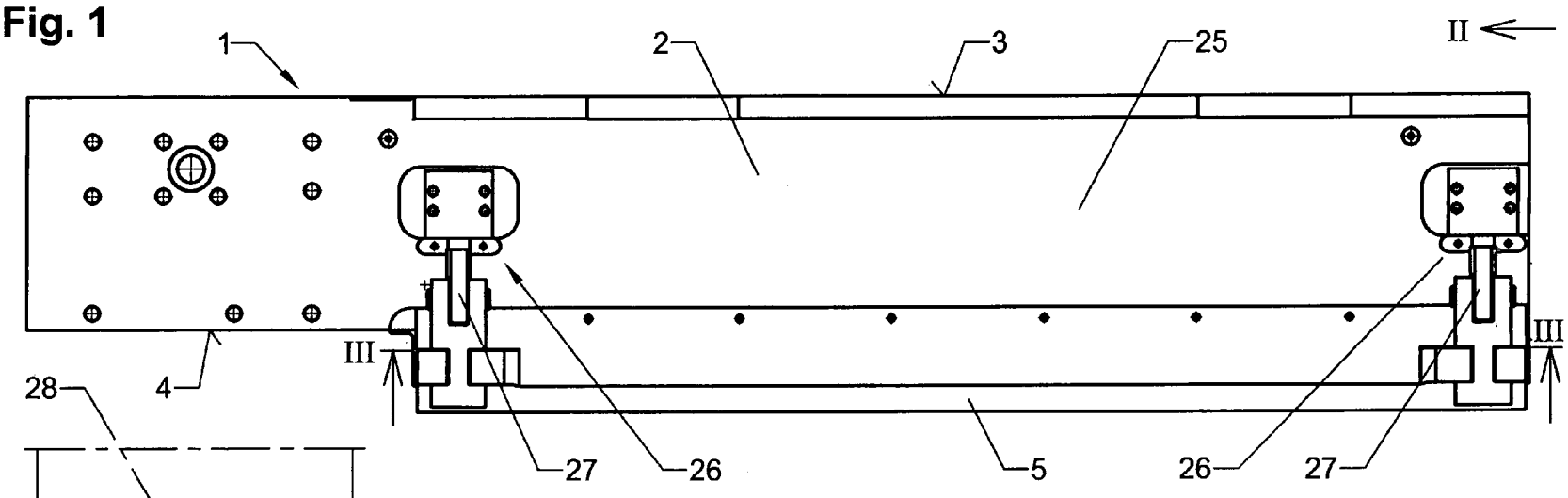
FIG. 1 is a front view of a cylinder unit according to the present invention.

The cylinder unit 1 illustrated in the drawing is intended for mounting on a crossmember and/or a table of a device or machine for deforming workpieces, not shown. The cylinder unit 1 is composed of a cylinder block 2 which can be mounted on the cross member and/or the table, and a pressure plate 5 mounted on a surface 4 of the cylinder block 2 facing away from the mounting surface 3. A plurality of pistons 6 each having a spherically shaped head 7 is mounted in the cylinder block 2, wherein the pistons 6 jointly act on the pressure plate 5.

Mounted on the spherically shaped head 7 of each piston 6 is a pressure piece 10 which protrudes into a bore 8 of the pressure plate 5 and is provided with a recess 9 which corresponds to the spherically shaped head 7. As particularly seen in FIG. 5, a gap s is provided between the outer diameter $d_A$ of each pressure piece 10 and the inner diameter $d_i$ of the bore 8, so that a length expansion due to heat does not result in a misalignment of the pressure piece 10 or the piston 6 in the bore 8 or in the bore 11 for the piston 6 in the cylinder block 2. A pressure disk 13, preferably of hardened material, is provided between the pressure piece 10 and the pressure plate 5 in the bottom 12 of the bore 8.

The pressure piece 10 has a coaxial guide pin 14 which projects beyond the piston 6 and in the direction of the piston 6, wherein the guide pin 14 projects into a coaxial bore 15 in the spherically shaped head 7 of the piston 6. An elastic guide sleeve 16 mounted in the bore 15 is arranged between the guide pin 14 and the bore 15.

Guide bolts 17 for guiding the pressure plate 5 during the upward and downward movements thereof are mounted in the pressure plate 5, wherein the guide bolts 17 protrude into the cylinder block 2 and are guided in the cylinder block 2. For this purpose, metal guide sleeves 19 are mounted in bores 18 in the cylinder block 2. Additional elastic guide sleeves 21 are provided for the guide bolts 17 between the guide bolts 17 and the bores 20 in the pressure plate 5. The guide bolts 17 are connected to the pressure plate 5 through divided disks 22 which engage in circumferential grooves 23 of the guide bolts 17.

The elastic guide sleeves 16, 21 in the bores 15, 20 additionally ensure that no misalignment or offset of the pistons 6 or the guide bolts 17 occurs due to length changes of the cylinder block 2 resulting from thermal expansion and machine deformations, because the elastic guide sleeves 16, 21 absorb length changes as well as misaligned or inclined positions.

Moreover, the elastic guide sleeve 16 ensures that each pressure piece 10 does not move relative to the piston 6 and maintains its centered position when the pressure is relieved. The elastic guide sleeve 21 additionally ensures that the pressure plate 5 is returned into its position when a temperature equalization occurs between the pressure plate 5 and the cylinder block 2.

Since the pistons 6 are constructed as single-acting cylinders, block cylinders 26 are arranged at the longitudinal sides 25 of the cylinder block 2 for the return stroke of the pressure plate 5. The piston rods 27 of the block cylinders 26 are connected to the pressure plate 5.

Figure 4:
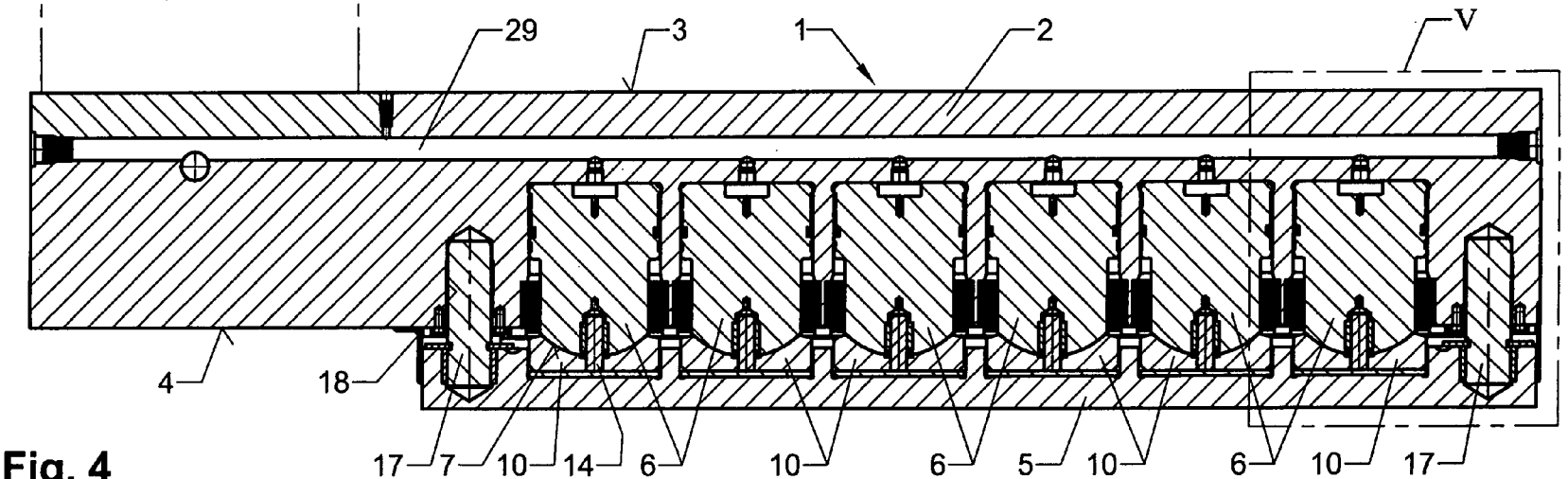
FIG. 4 is a sectional view taken along sectional line IV-IV in FIG. 3.
Figure 3:
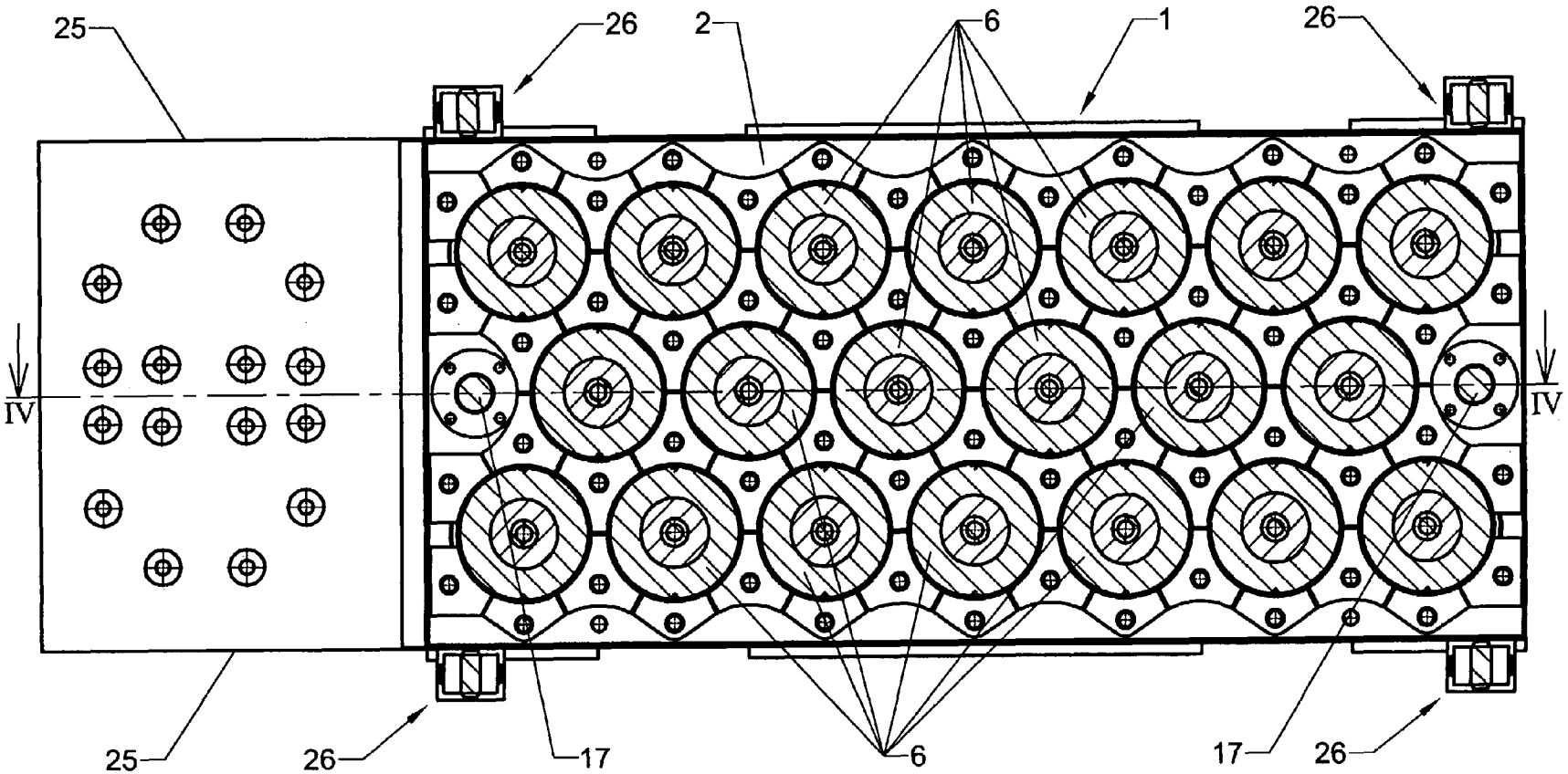
FIG. 3 is a sectional view taken along sectional line III-III in FIG. 1.

In order to realize the high pressures in the case of the necessary nominal widths, and to make expensive pipe connections to the pistons 6 unnecessary, at least one pressure intensifier 28, schematically illustrated in FIG. 4 in dash-dot lines, is arranged on the mounting surface 3 in an area outside of the cross member and/or the table, wherein the pressure intensifier 28 acts through connecting bores 29 in the cylinder block 2 directly on the pistons 6.

While specific embodiments of the invention have been shown and described in detail to illustrate the inventive principles, it will be understood that the invention may be embodied otherwise without departing from such principles.

I claim:

1. A cylinder unit for mounting on a cross member and/or a table of a device or machine for deforming workpieces, the cylinder unit comprising a cylinder block adapted to be attached to the cross member and/or the table, a pressure plate mounted on a surface of the cylinder block facing away from a mounting surface, a plurality of pistons having spherically shaped heads mounted in the cylinder block for acting on the pressure plate, guide bolts mounted in the pressure plate, wherein the guide bolts protrude into the cylinder block and are guided in the cylinder block, a pressure piece mounted on the spherically shaped head of each piston, wherein the pressure piece protrudes into a bore of the pressure plate and has a recess which corresponds to the spherically shaped head, wherein a gap is provided between an outer diameter of the pressure piece and an inner diameter of the bore in the pressure plate, a pressure disc arranged in a bottom of the bore in the pressure plate between the pressure piece and the pressure plate, each pressure piece having a coaxial guide pin projecting beyond the pressure piece in a direction toward the piston, wherein the guide pin protrudes into a coaxial bore in the spherically shaped head of the piston, an elastic guide sleeve mounted in the coaxial bore between the guide pin and the coaxial bore, and an additional elastic guide sleeve mounted between each guide bolt and an additional bore in the pressure plate for the guide bolt, wherein the additional elastic guide sleeve is mounted in the additional bore.

2. The cylinder unit according to claim 1, wherein the pressure disc is of hardened material.

3. The cylinder unit according to claim 1, further comprising block cylinders for a return stroke of the pressure plate, wherein the block cylinders are mounted on longitudinal sides of the cylinder block, and wherein piston rods of the block cylinders are connected to the pressure plate.

4. The cylinder unit according to claim 1, further comprising at least one pressure intensifier mounted on the mounting surface in an area outside of the cross member and/or the table, wherein the at least one pressure intensifier is configured to act through connecting bores in the cylinder block directly on the pistons.

* * * * *